US006073776A

United States Patent [19]

Seymour et al.

[11] Patent Number: 6,073,776

[45] **Date of Patent: *Jun. 13, 2000**

[54] SEPARATION OF ANOMALOUS ITEMS

[75] Inventors: Thomas A. Seymour, Orange Park; Edward A. Green, Jacksonville; Richard Pralat, Deltona, all of Fla.

[73] Assignee: Unisys Corporation, Blue Bell, Pa.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/754,819

[22] Filed: Nov. 21, 1996

Related U.S. Application Data

[60] Provisional application No. 60/007,620, Nov. 29, 1995.

[51] Int. Cl.[7] ..... B07B 13/05

[52] U.S. Cl. ..... 209/680; 271/210

[58] Field of Search ..... 209/680, 682, 209/900, 920, 684, 702, 703; 271/210, 220, 221, 222

[56] References Cited

U.S. PATENT DOCUMENTS

| | | | |
|---|---|---|---|
| 2,650,109 | 8/1953 | Johnson | 271/210 |
| 3,223,410 | 12/1965 | Wilson et al. | 271/210 |
| 3,946,879 | 3/1976 | Jensen | 271/210 |
| 4,662,522 | 5/1987 | Kokubun et al. | 209/682 |
| 5,154,038 | 10/1992 | Capaci | 209/680 |
| 5,622,269 | 4/1997 | Seymour et al. | 209/680 |

*Primary Examiner*—Robert P. Olszewski
*Assistant Examiner*—Thuy V. Tran
*Attorney, Agent, or Firm*—Rocco L. Adornato; Mark T. Starr; Steven B. Samuels

[57] ABSTRACT

A method for jogging bunches of standard-size documents of prescribed height mixed in with anomalous- size documents of lesser height, these standard-size documents to be shaken and tilted to register against a first-wall of a receptacle. This method also involving: relieving the first wall to form a cutout to pass only the anomalous-size documents; providing a second wall in the receptacle forward of the first wall; and shaking the documents so as to register the forward edges of the anomalous-size documents against the second wall after passing through the cutout.

19 Claims, 9 Drawing Sheets

SEPARATION OF ANOMALOUS ITEMS

This is a Continuation of our provisional application, U.S. Ser. No. 60/007,620 filed Nov. 29, 1995 and claims priority therefrom under 35 USC.

This relates to machine processing of items of different sizes, and especially to separation operations therefor.

BACKGROUND, FEATURES

Workers in the items processing arts (e.g., machine processing of documents) know that it is common to subject stacks of such items to a "jogging" operation where the items are confined and shaken on a flat surface (e.g., jogging table) to help align their edges.

A problem can develop when different-size documents are mixed-in e.g., when a stack of one-size checks includes different-size adding-machine tape, or the like. Since the automatic high-speed processing line is geared to the common size and weight of identical unit-record documents (e.g., checks), such "anomalous documents" (tapes) must be removed before machine processing—e.g., lest they cause a jam, a "reject condition" or a "mis-sort" or "feed check". Presently, an operator must inspect all check-stacks and manually find and remove each such tape. Of course, removing the adding machine tapes will improve throughput and result in fewer rejects. Rejects are an added expense because the check has to be rerun through another check processing machine. Thus, expedited tape-removal at the jogger is an object hereof.

Thus, an object hereof is to address and resolve at least some of these problems and provide at least some of the here-described features. A particular object is to separate tape items from stacks of checks. A more particular object is to remove adding machine tapes from bundles of checks prior to feeding the checks through a check processing machine—e.g., doing so in a jogger, while allowing for adding machine tapes to jog down against a novel storage zone therefor and be easily seen and removed.

Other objects and advantages of the present invention will be apparent to those skilled in the art.

BRIEF DESCRIPTION OF THE DRAWINGS

The foregoing and other features and advantages of the present invention will be appreciated by workers as they become better understood by reference to the following detailed description of the present preferred embodiments, these being considered in conjunction with the accompanying drawings, wherein like reference symbols denote like elements:

FIG. 4 is a side sectional view showing an exemplary check stack ch in a like jogger-tray 1' without the tape-separating space etc.; while

EMBODIMENT DETAILED

Figure 1:
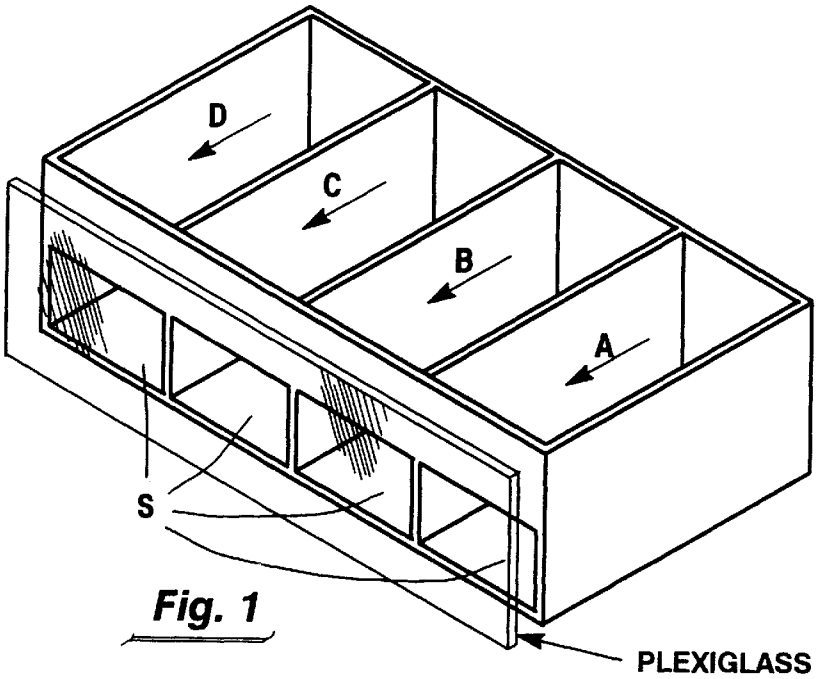
FIG. 1 is a very schematic, idealized showing of a novel check-jogger tray which includes a tape-segregating area according to an embodiment of the invention.
Figure 2:
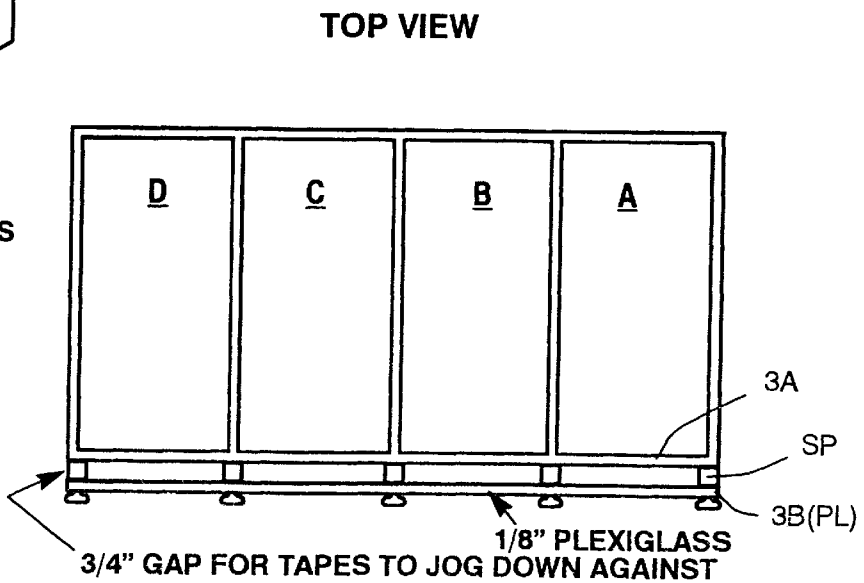
FIG. 2 gives a plan view thereof (FIG. 2A including several check tape bunches merged into a stack ST), and FIG. 3 a front view thereof.
Figure 3:
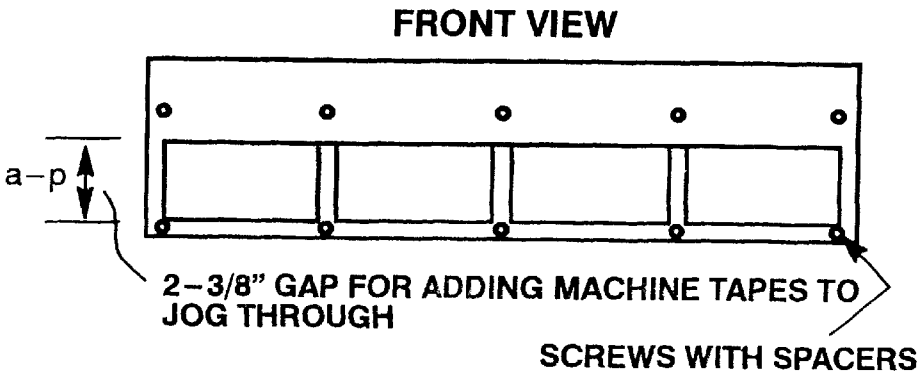
Figure 10:
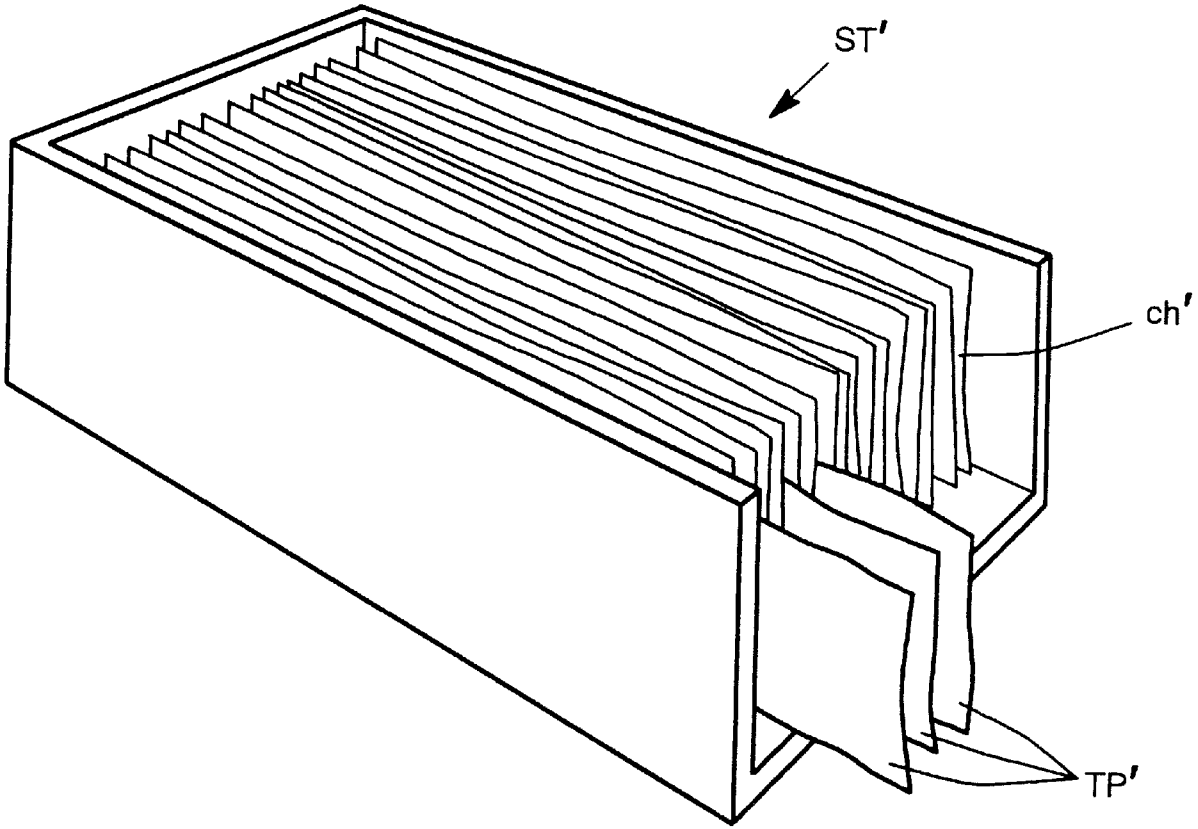
FIG. 10 schematically illustrates a sample array of "fully-jogged" check bunches incorporated into a stack ST', with separated tapes TP' shown protruding therefrom.

A preferred embodiment is depicted in FIG. 1–3 where a base-unit of a 4-pocket check-jogger 1 is modified, according to the invention, to facilitate separation and extraction of adding machine tapes from bundles of checks prior to running these checks through a check sorting machine. This embodiment allows the adding machine tapes to be easily detected, by protruding out further than the rest of the bundle of checks (e.g., as seen in FIG. 10). When an operator picks up the stack checks/tapes (e.g., after jogging in our embodiment) he can then more readily see -and remove the adding machine tapes and then insert the bunch of tape-removed checks into a machine to be processed. Extracting these tapes, allows the checks to be processed more efficiently. This, in turn, improves throughput of check sorters, by avoiding jams, missorts, and needless rejects. These problems cost money; e.g., they can retard processing of checks or can force one to run rejects through slower check sorting equipment.

FIG. 1 gives an idealized upper perspective of a jogger tray 1 which, according to a preferred embodiment, includes a see-through storage area S for receiving adding machine tapes, or like "anomalous documents". Tray 1 is adapted to receive stacks of standard-size documents (e.g., checks 6" long×2¾" high) in various pockets (e.g., four like pockets shown: A,B,C,D) which are each roughly as long as a check-length. Tray 1 will be understood as to be mounted on a mechanical jogger (or shaker) means JB' adapted to tilt the in-tray check stacks down toward their "front-edges" (direction of arrows) and shake it sufficient to quickly align one edge of all checks in a stack or bundle. Tray 1 will generally comprise a flat base b and four like walls (front, back, side) with separators for each pocket.

After the requisite shaking (jogging) and when such alignment is complete, a single stack of checks can be picked up from each pocket and injected into an automatic check processor machine (not shown, but well known in the art). But, as mentioned, any "tapes" or other "anomalous-size" documents must first be removed and not so processed.

Here, we assume that the checks are all 6 inches long by 2 ¾ inches high, while the tapes are smaller (e.g., about 4–5 inches long by 2–2¼ inches high).

Figure 4:
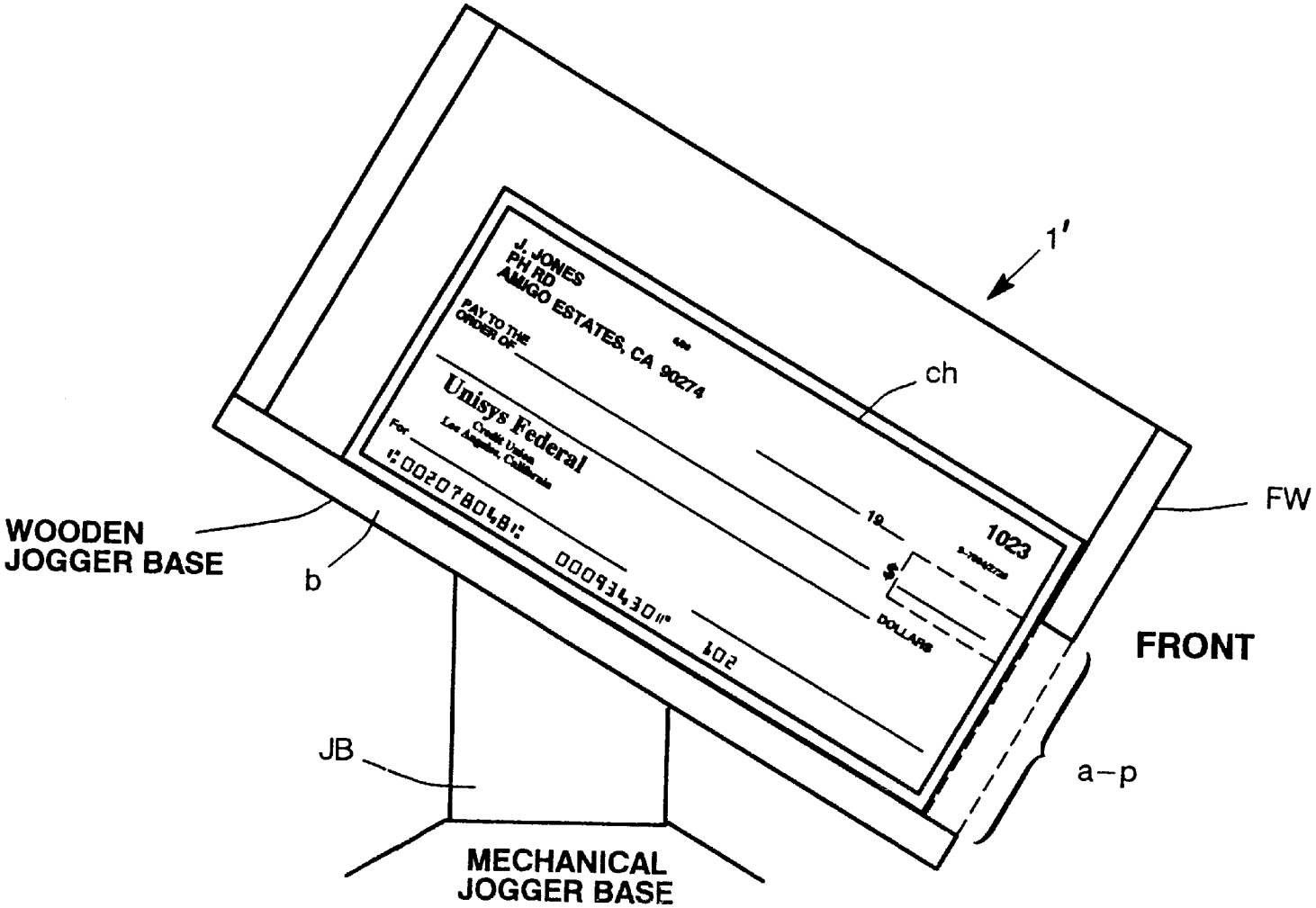
Figure 5:
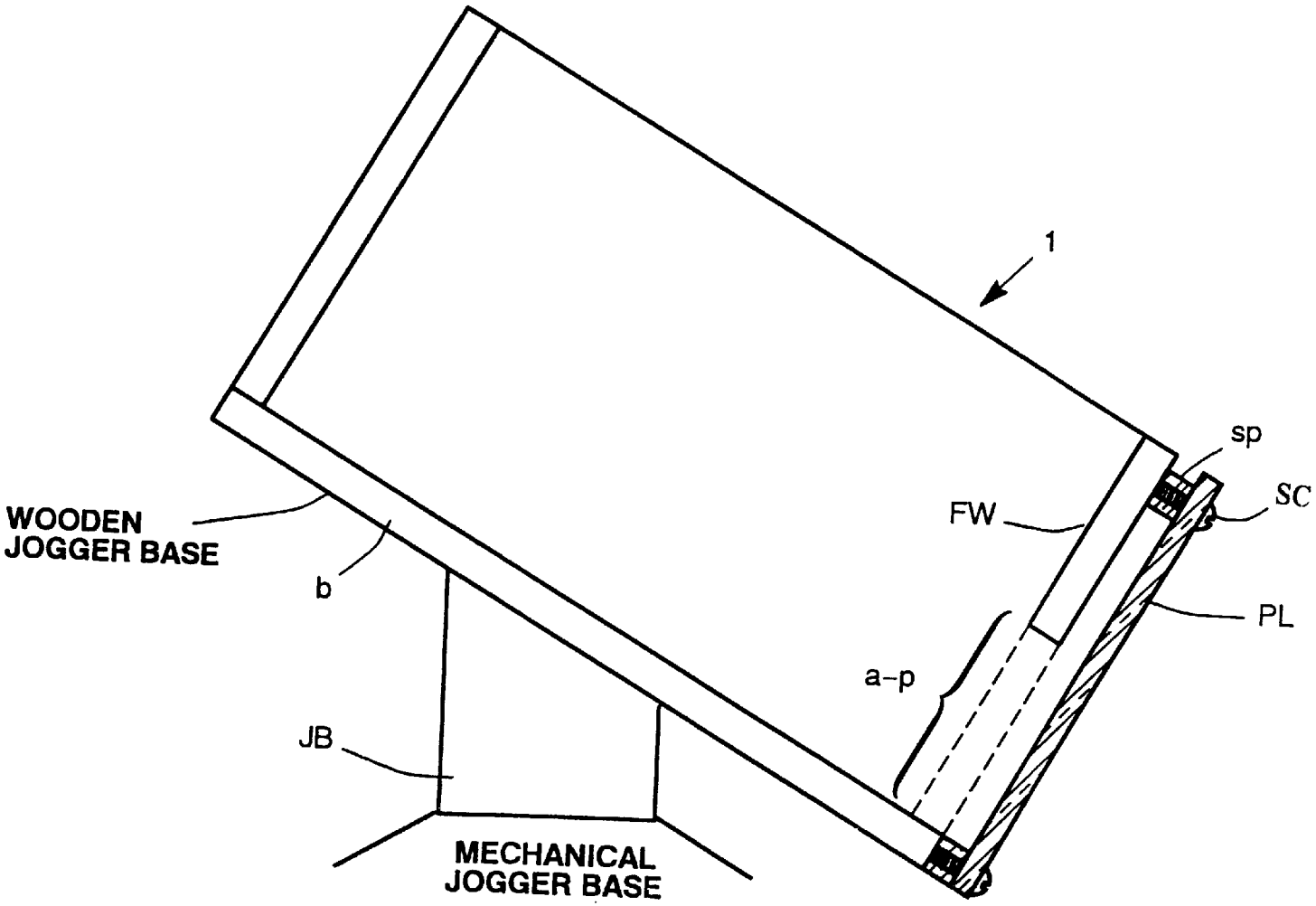
FIG. 5 shows the same with transparent wall PL added to create this space.
Figure 6:
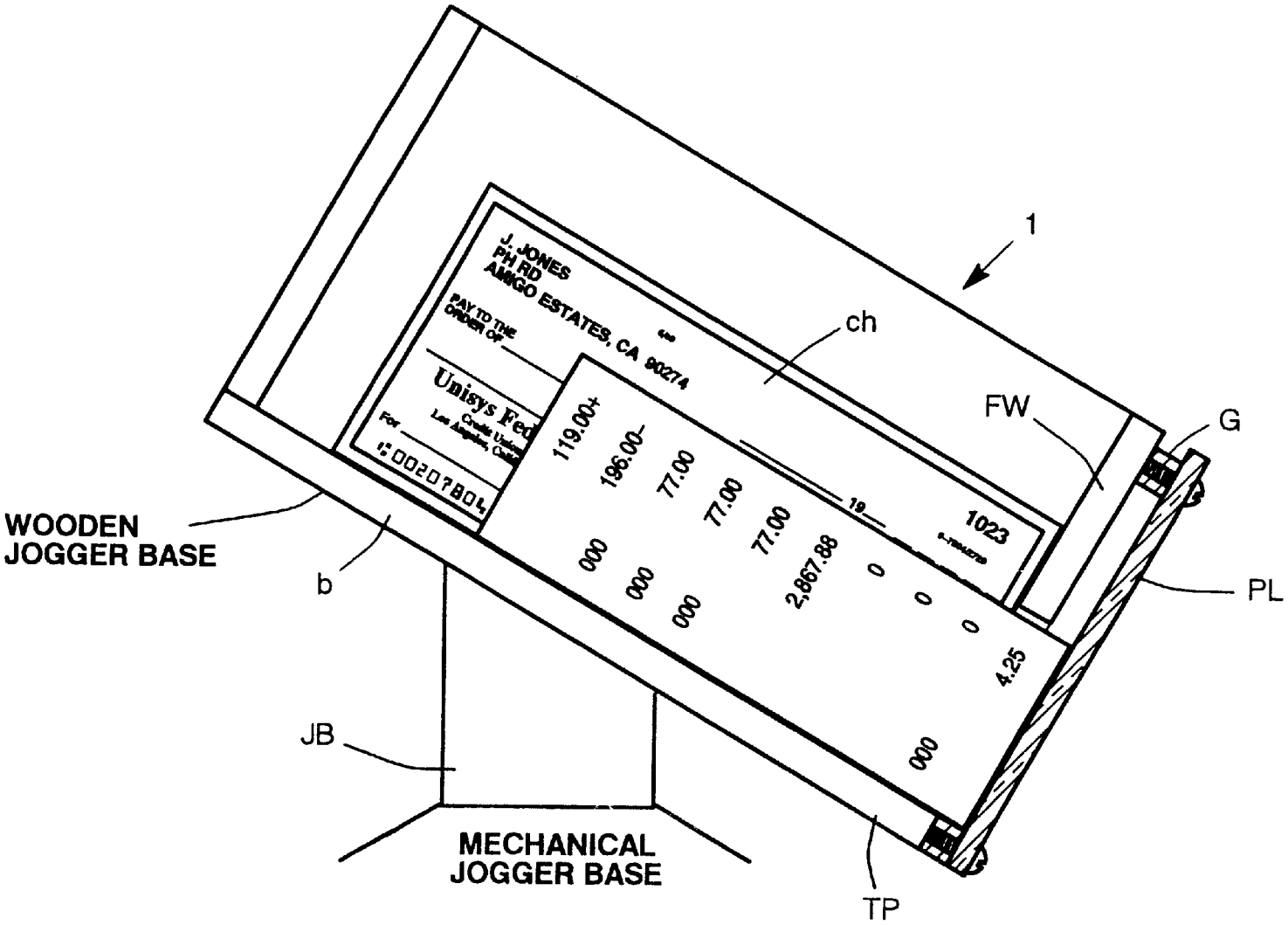
FIG. 6 shows the FIG. 5 construction with checks ch and tapes TP therein.

According to a feature of this embodiment, the front wall Fw of tray 1 (e.g., see FIGS. 1–6) includes a recess S to receive protruding tapes (e.g., as in FIGS. 6, 10). Preferably, this is provided by constructing wall Fw as a "stop", to leave a lower aperture a-p sized and located so each of the four compartments will admit protrusion of the tapes TP. Aperture a-p (CH) will thus be less than a check-height (SH) and a bit more than "tape-height" (AH) (e.g., here about 2⅜" high for checks 2¾" high, or more, and for tapes 2¼" high, or less—e.g., see FIGS. 4–6).

Figure 2A:
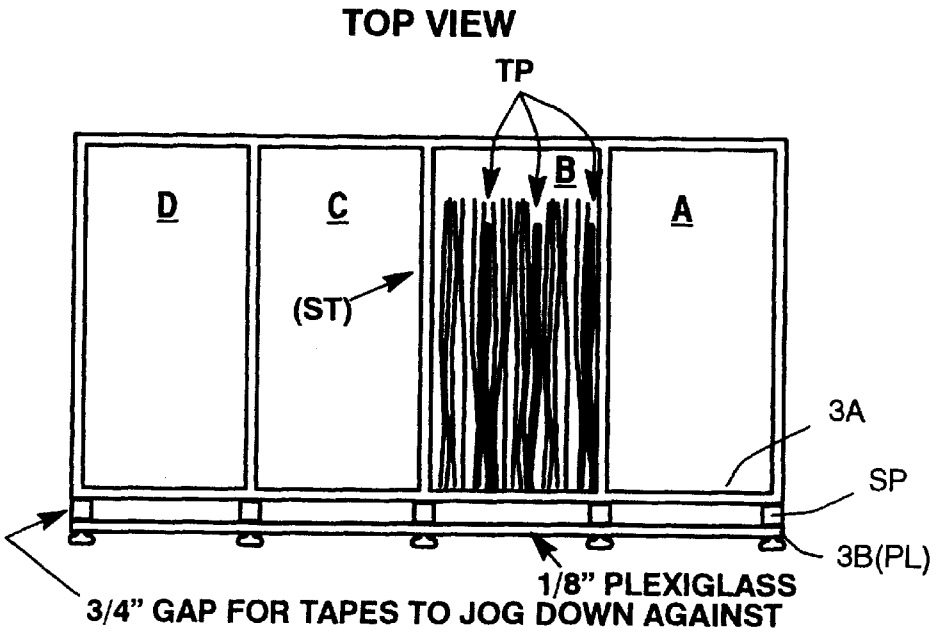

Also, a transparent Gap-wall PL is added (e.g., see FIGS. 5, 6, where added to tray 1' in FIG. 4) and preferably spaced from wall Fw sufficient to establish a "protrusion-gap" p-g for the tapes—to be shaken-down beyond a stack of checks in a tray-pocket, to emerge therein, protruding from their respective stacks (e.g., as in FIG. 2A, where the bundle ST' shown in pocket B of tray 1 is understood to be shaken-down by the shown embodiment to leave its three tapes TP protruding from the multi-stack bundle so-shaken therein—e.g., as in FIG. 10—and, as workers realize, an operator may readily extract bundle ST from such a pocket B and easily remove to protruding tapes TP therefrom).

Wall PL is preferably made transparent to allow operators to "eyeball" the tape-check stacks inserted in the embodiment tray and quickly detect any problems (e.g., ⅛" Plexiglas is preferred here, secured to Tray 1 via fastening means and spacers e.g., screws SC and rubber spacers SP to help set gap G, FIG. 6—along with the thickness of stop Fw. Here, the spacers SP are about ½ long, and wall Fw is about ¼" thick to thus establish a protrusion-gap p-g of about ¼").

FIGS. 1–6 will thus be understood as showing a modified 4-pocket jogger tray 1 with cutouts (pref. 2⅜" high) to allow only tapes to slip under stop-wall Fw and rest vs clear Plexiglas front-wall PL, allowing an operator to notice, and remove, the tapes from a check-bundle being jogged. Preferably, the protrusion-gap p-g is made about ¾" long (by spacers SP, between walls Fw, PL and by the width of stop-wall Fw). Gap (see storage S, page 5) allows the adding machine tapes to fall down against the Plexiglas wall PL, so a "work prep" person can remove these tapes from the work to be run through the check sorter machine. Removing these tapes will reduce jams, feedchecks, and rejects (which cost money). This will increase performance and throughput.

Figure 7:
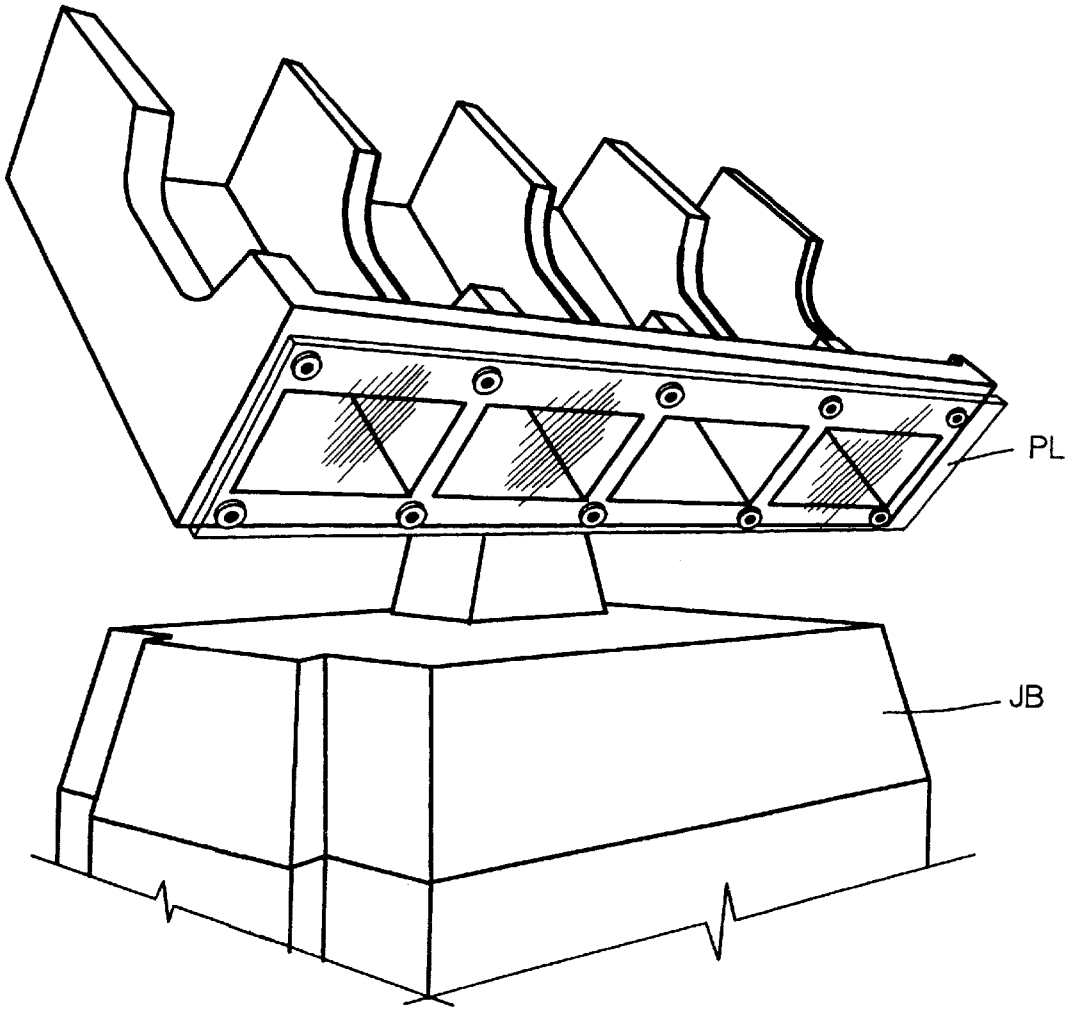
FIGS. 7–9 reproduce photographs of a mock-up of such a modified jogger tray in various views.
Figure 8:
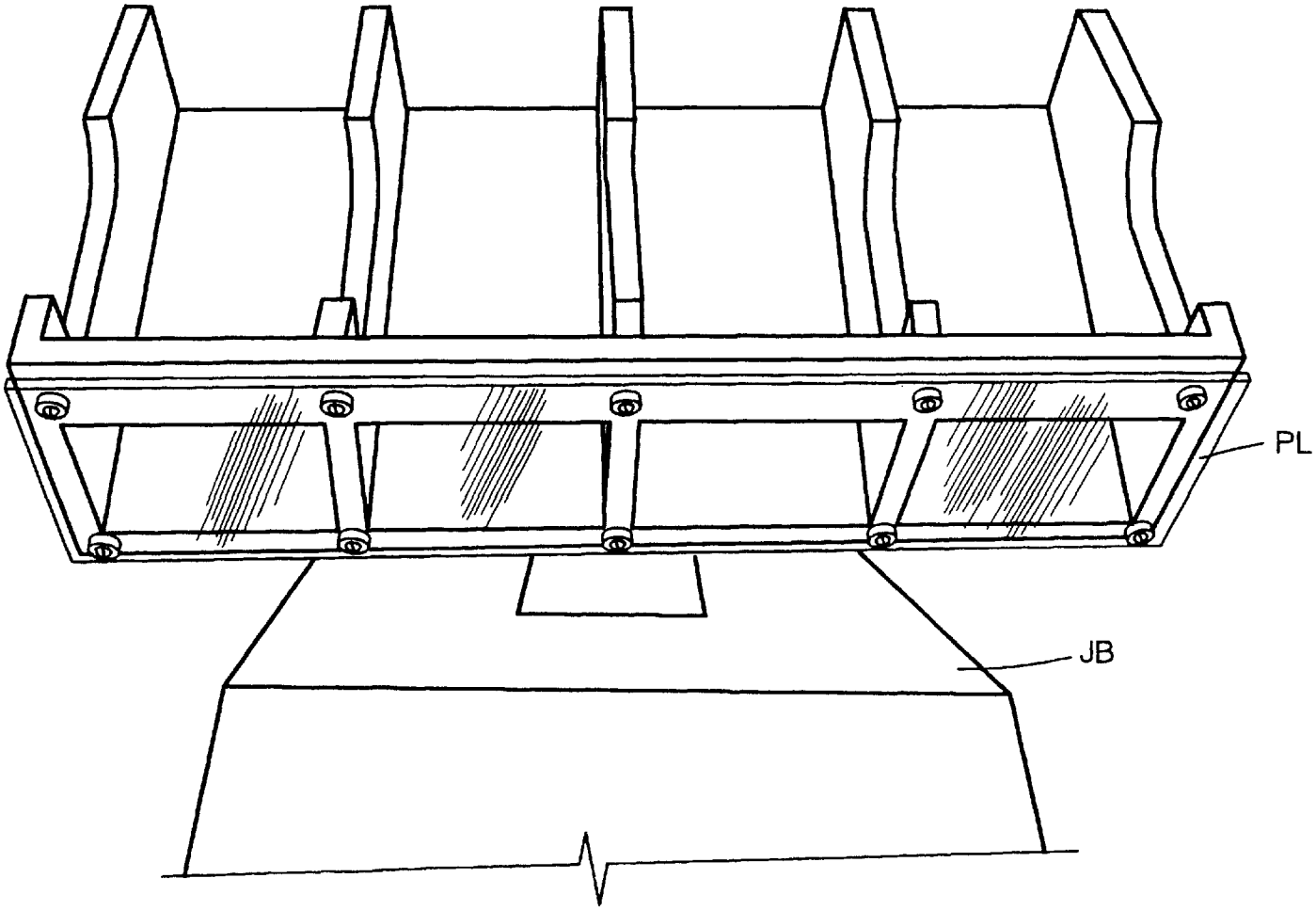
Figure 9:
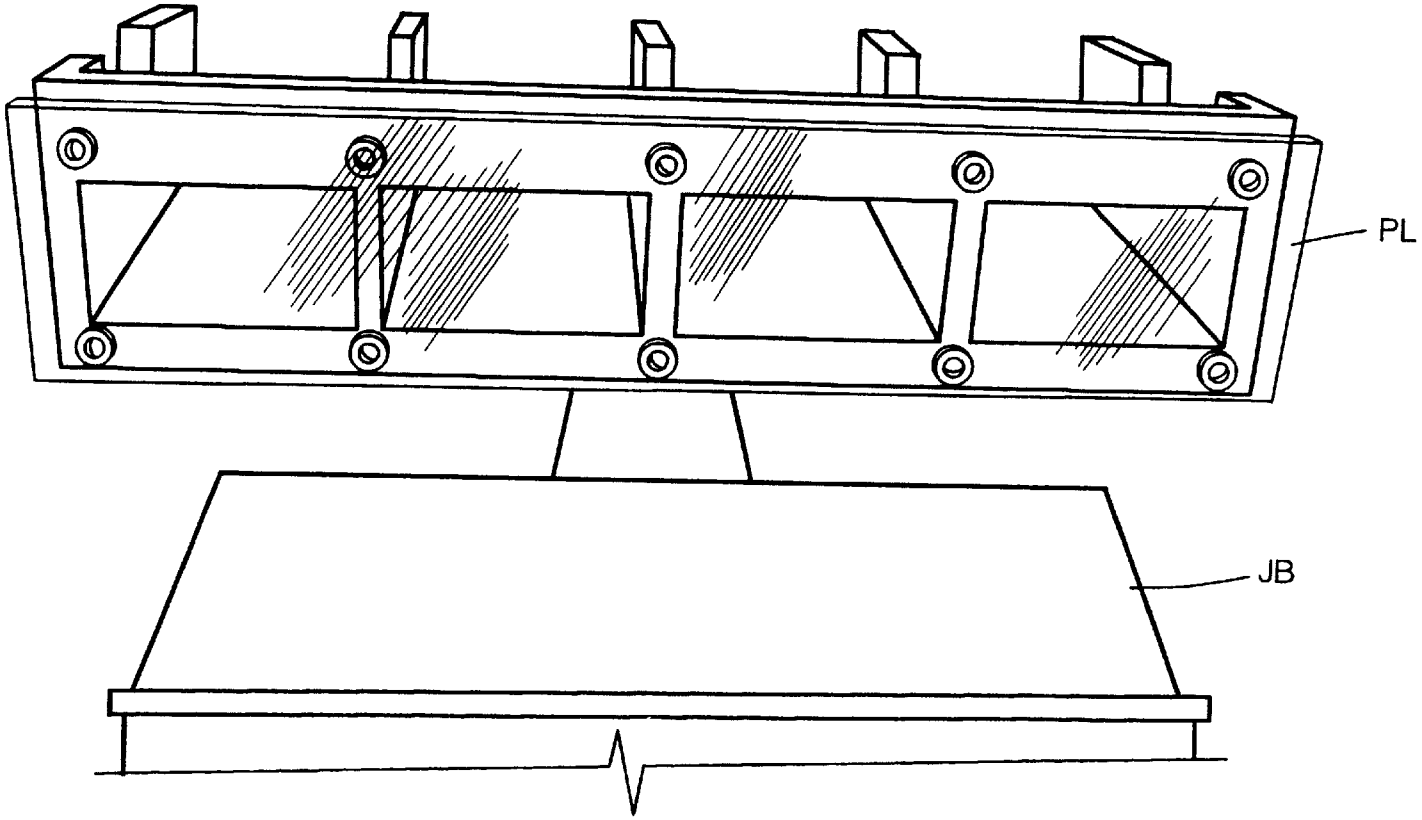

FIGS. 7–9, replicate photographs of a mock-up of such a modified Jogger-tray 1, shown there in various views (e.g., upper-perspective, side view in FIG. 7; in upper-perspective front view in FIG. 8 and in front, elevation in FIG. 9).

Results

It will be apparent that our aforedescribed invention is apt for effecting the objects mentioned; e.g., to separate "anomalous-sized" documents from "standard-size" documents stacked in a jogger or like receptacle.

It will be evident that this separation is preferably effected by providing a forward stop-wall above an "under-height" passageway and associated tape-edge storage area in the "front" of leading-wall of such a receptacle.

Of course, modifications to the preferred embodiment described are possible without departing from the spirit of the present invention. For example, there are other different ways to provide such a stop-wall, such a separation-aperture and/or such an associated storage zone, and the invention is not limited to the particular types of receptacles, joggers or the particular types of "standard unit record" documents or tapes described. Additionally, some features of the present invention can be used to advantage without the corresponding use of other features.

For instance, in certain cases the forward wall PL need not be transparent; also in related cases, wall PL may simply abut stop-wall Fw, whose thickness, alone, will thereby define the "tape-protrusion-space".

Accordingly, the description of the preferred embodiment should be to be considered as including all possible modifications and variations coming within the scope of the invention as defined by the appended claims.

What is claimed is:

1. Apparatus for jogging one or several bunches of standard-size documents of prescribed height, mixed in with anomalous-size documents of lesser height, these documents to be disposed on an IN-surface of a receptacle, to be jogged by shaking and tilting to register a forward edge of the standard-size documents against a prescribed registration-wall extending across said IN-surface, this apparatus further comprising:

cutout means in said wall to pass only said anomalous-size documents onto an OUT-surface, and means for shaking said documents so as to register the forward edges of said standard-size documents against said registration-wall, while inducing said anomalous-size documents to pass through said cutout and along said OUT-surface, said OUT-surface projecting outwardly in the same plane from said IN-surface to allow said anomalous size documents to move along said OUT-surface during said jogging.

2. The apparatus of claim 1, wherein said cutout means is arranged to exhibit a height (CH) at least greater than the height (AH) of said anomalous-size documents and less than the height (SH) of said standard-size documents.

3. The apparatus of claim 1, wherein said protrusion-gap p-g is at least sufficient for an operator to perceive and remove said anomalous-size documents from each said bunch once the bunch is fully shaken-down.

4. The apparatus of claim 3, wherein said protrusion-gap p-g is sufficient that said anomalous-size documents are noticed there.

5. The apparatus of claim 3, wherein said protrusion-gap p-g is defined by prescribed separator means.

6. The apparatus of claim 1, wherein said wall is made somewhat transparent for better viewing documents protruding therebeyond.

7. The apparatus of claim 6, wherein said standard-size documents are checks.

8. The apparatus of claim 7, wherein said anomalous-size documents are adding machine tapes.

9. The apparatus of claim 8, wherein said checks are so jogged to prepare them for insertion into automatic check-processing equipment.

10. The apparatus of claim 9, wherein said checks are about 2¾" high or more.

11. The apparatus of claim 10, wherein said tapes are about 2¼" high or less.

12. The apparatus of claim 11, wherein said cutout is between 2¾" and 2¼" high.

13. Receptacle means including a barrier, said receptacle means including an IN-surface adapted for jogging one or several bunches of first-size documents of prescribed height mixed in with anomalous-size documents of lesser height, these first-size documents to be jogged by shaking and tilting so as to register a forward edge thereof against said barrier when jogged; said barrier adapted to register said forward edge of said first-size documents doing jogging, said receptacle further comprising:

a relief means in said barrier sized to pass only said anomalous-size documents onto an OUT-surface, and jog means for shaking said receptacle means so as register said first size documents against said barrier and also to pass said anomalous-size documents through said relief means and beyond onto said out-surface means, said OUT-surface projecting outwardly in the same plane from said IN-surface to allow said anomalous size documents to move along said OUT-surface during said jogging.

14. Apparatus including receptacle means for jogging one or several bunches of first-size documents of prescribed height, mixed in and placed with anomalous-size documents of lesser height onto an In-surface, these documents to be shaken and tilted in said receptacle means, this apparatus further comprising:

barrier means disposed in said receptacle means for registering the leading edges of said first size documents;

cutout means through said barrier means to allow said anomalous-size documents to pass therebeyond; an Out-surface extending said IN-surface outwardly in the same plane to receive said anomalous-size documents that have passed beyond said cutout means; and means for shaking/tilting all said documents in said receptacle means so that said first-size documents are so registered against said barrier means, and so that said anomalous-size documents pass beyond said barrier means via said cutout means and onto said OUT-surface.

15. Apparatus, including a receptacle with a wall, for jogging one or several bunches of first-size documents of prescribed minimum height (SH), mixed in with anomalous-size documents of lesser height on an In-surface; these first-size documents to be shaken and tilted to register a forward edge against said wall, this apparatus further comprising:

cutout means relieving said wall so as to pass only said anomalous-size documents; an Out-surface projecting outwardly in the same plane from said IN-surface, said OUT-surface being disposed to receive documents passing beyond said cutout means, being spaced a prescribed protrusion-gap forward of said wall; and means for shaking all said documents in said receptacle so as to register the forward edges of said first-size documents against said wall, and to induce said anomalous-size documents to pass through said cutout means onto said OUT-surface.

16. The apparatus of claim 15, wherein said cutout means is arranged to exhibit a height (CH) at least greater than the maximum height (AH) of said anomalous-size documents and less than the height (SH) of said first-size documents.

17. Apparatus including receptacle means for jogging one or more bunches of first-size items of prescribed minimum height mixed in with anomalous-size items of lesser height, these items to be shaken and tilted along an In-surface in said receptacle means, this apparatus further comprising:

barrier means in said receptacle means to register the leading edges of said first size items during jogging; an Out-surface in said receptacle means being a continuation of said IN-surface, extending beyond said barrier means;

cutout means in said barrier means to allow only said anomalous-size items to pass therebeyond onto said OUT-surface means during jogging; and means for shaking/tilting all said items in said receptacle means so that said first-size items are so registered against said barrier means, and so that said anomalous-size items pass beyond said barrier means via said cutout means to protrude onto said OUT-surface.

18. In a jogger apparatus for aligning documents of several heights, a jogger receptacle including flat tilt-surface means adapted to receive one or more bunches, each including standard-height documents of prescribed height as well as anomalous-height documents of lesser height, all documents to be aligned on edge on said surface means, and to be shaken and tilted so said standard-height documents register a forward edge against a prescribed wall of the receptacle and wherein:

said wall is cutout to pass only said anomalous-height documents during shaking and tilting, and is also combined with OUT-surface means which extends said tilt-surface means, and on which said anomalous-height documents may rest, extending at least a prescribed protrusion-gap (p-g) forward of said wall and from which said anomalous-height documents may rest to be extracted and separated from said standard-height documents under shaking.

19. The apparatus and receptacle of claim 18, wherein said cutouts have a height (CH) greater than the height (AH) of said anomalous-height documents and less than the height (SH) of said standard-height documents.

* * * * *